United States Patent [19]

Moskovitz

[11] Patent Number: 4,740,010

[45] Date of Patent: Apr. 26, 1988

[54] FOLDABLE CART

[75] Inventor: Milton A. Moskovitz, Nashville, Tenn.

[73] Assignee: Accurate Metal Products, Inc., Murfreesboro, Tenn.

[21] Appl. No.: 924,905

[22] Filed: Jan. 9, 1987

[51] Int. Cl.[4] ..... A47B 3/00

[52] U.S. Cl. ..... 280/641; 108/111

[58] Field of Search ..... 280/639, 641, 642; 108/111

[56] References Cited

U.S. PATENT DOCUMENTS

| | | | |
|---|---|---|---|
| 1,304,847 | 5/1919 | Blais et al. | 108/111 |
| 1,408,604 | 3/1922 | Kawa | 108/111 |
| 2,052,803 | 9/1936 | Schmoller | 280/641 |
| 2,596,986 | 5/1952 | Curtis | 280/641 |
| 2,720,402 | 10/1955 | DePuy et al. | 280/641 |
| 2,738,664 | 3/1956 | Edgar | 280/641 |
| 2,865,646 | 12/1958 | Kronhaus | 280/641 |
| 3,202,438 | 8/1965 | Panknin et al. | 280/42 |
| 3,536,016 | 10/1970 | Chesley | 108/111 |
| 4,236,462 | 12/1980 | Berthier et al. | 280/641 |
| 4,326,731 | 4/1982 | Woychio et al. | 280/641 |

*Primary Examiner*—Richard A. Bertsch

*Attorney, Agent, or Firm*—Harrington A. Lackey

[57] ABSTRACT

A foldable cart including a plurality of vertically spaced pairs of shelf members, their outer ends being pivotally connected to a pair of end frames, a lift bar pivotally connected to the inner ends of the shelf members and linked to the end frames for collapsing the shelf members and end frames to an inoperative folded position, and a stop member associated with the lift bar for limiting the downward movement of the lift bar when the pairs of shelf members are in a horizontal, coplanar operative position.

17 Claims, 3 Drawing Sheets

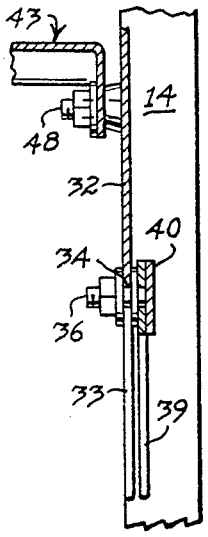
FIG. 5
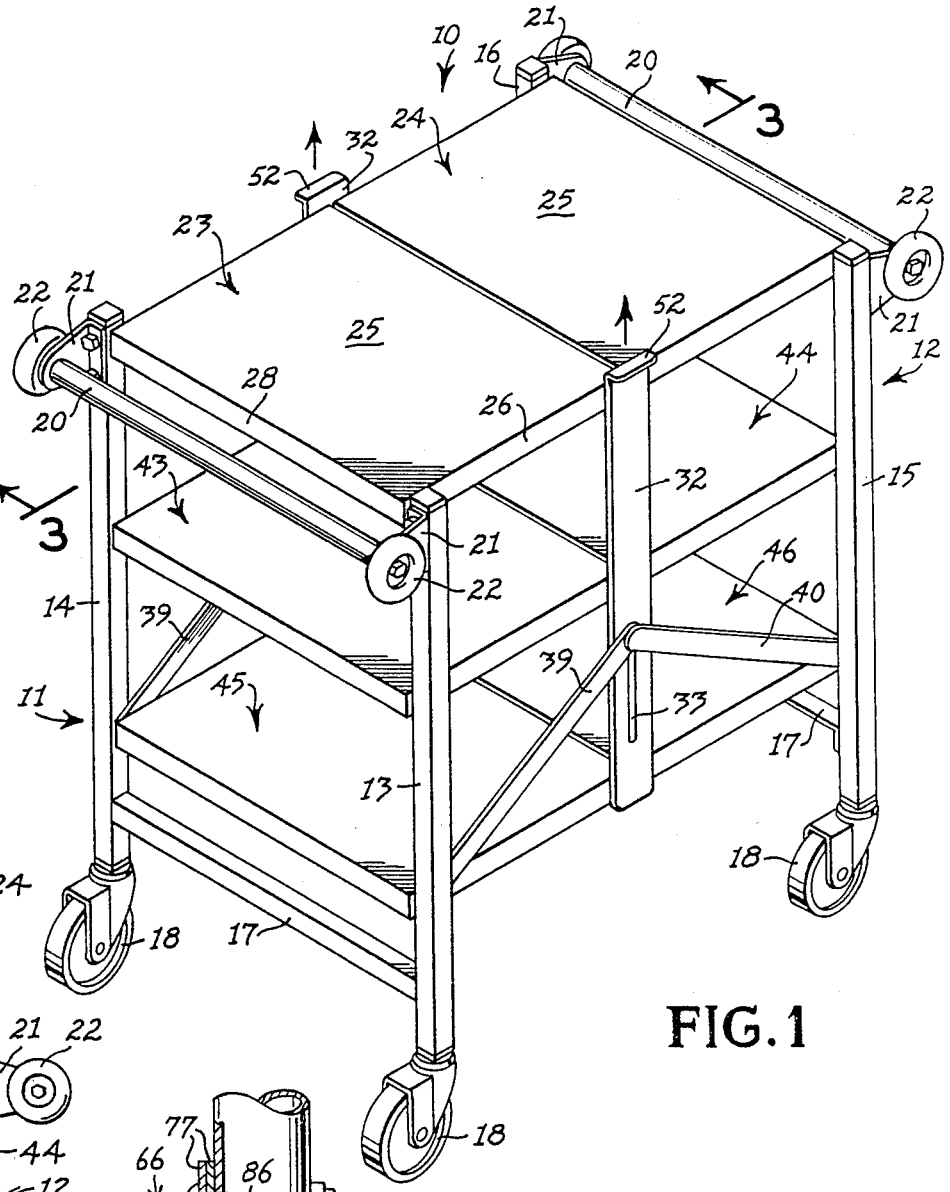
FIG. 1
FIG. 2
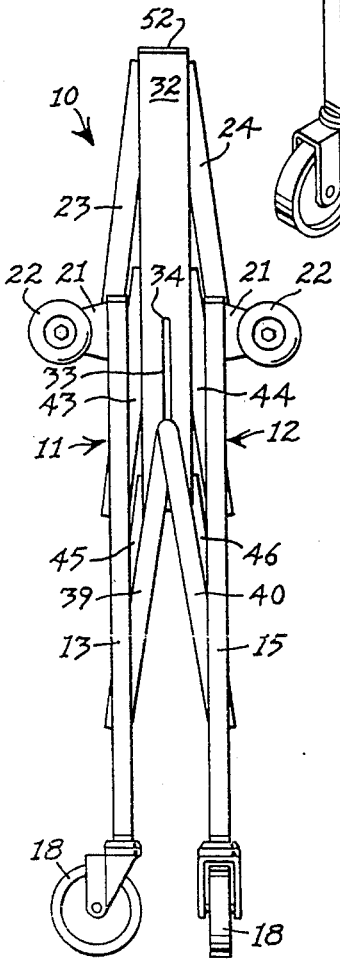
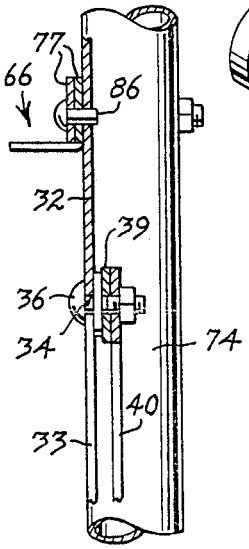
FIG. 9
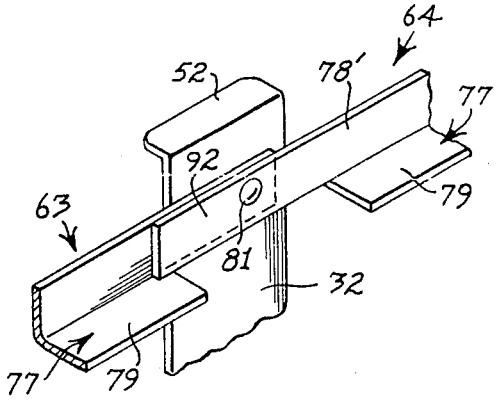
FIG. 10

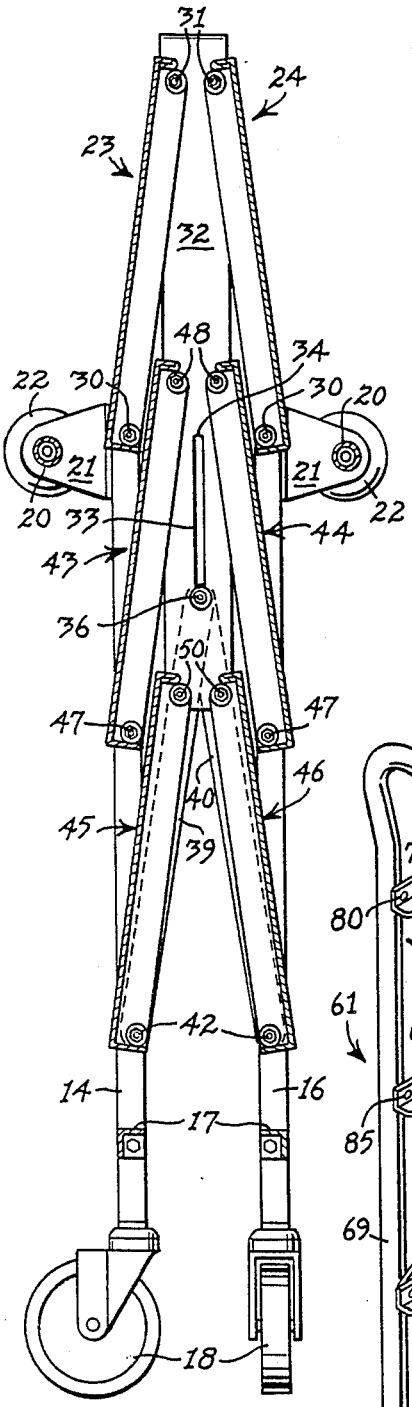
FIG.6
FIG.8
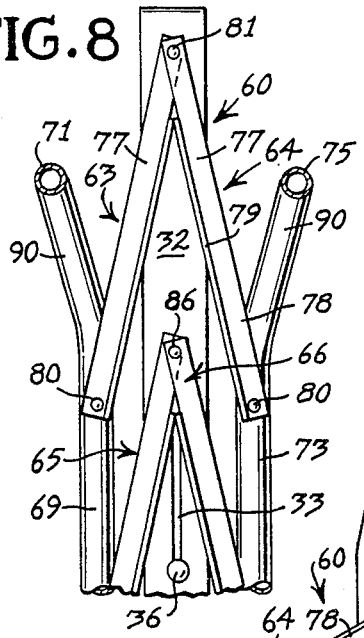
FIG.11
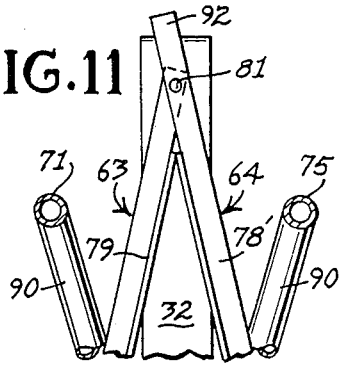
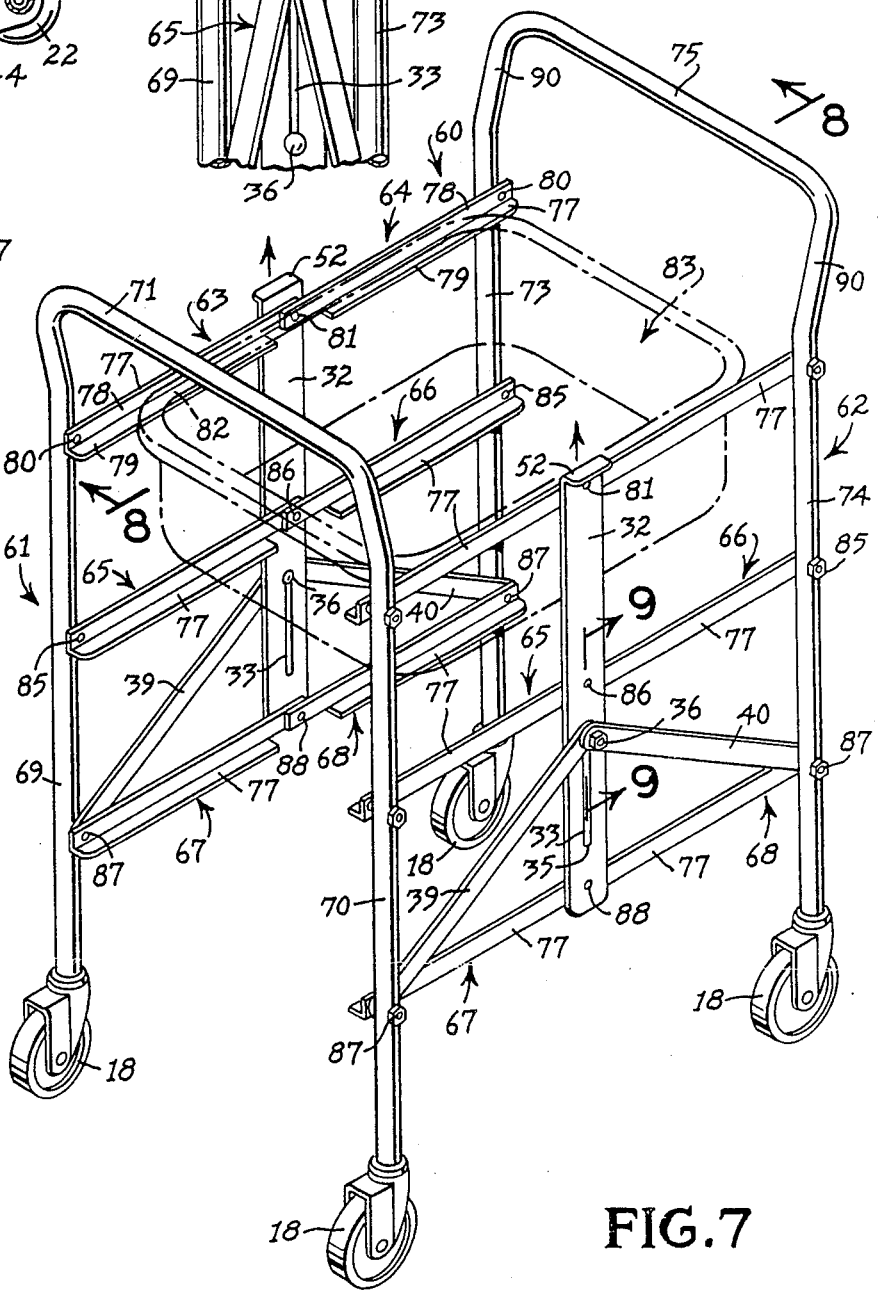
FIG.7

FOLDABLE CART

BACKGROUND OF THE INVENTION

This invention relates to a foldable cart, and more particularly to a foldable cart having hinged shelf members.

Most service carts, such as those used as food service carts in restaurants and institutions, or as used in health care institutions for carrying medical supplies, or as used in industry for carrying parts, supplies and products, have a plurality of rigid shelf members. These shelf members may be in the form of solid shelves or shelf rails for receiving receptacles, in which the cart and shelves are rigid and occupy the same amount of storage space as they do when being utilized.

Some service carts have a knock-down construction in which the parts may be disassembled for transportation and storage, but must be re-assembled before the cart can be utilized for its desired function. U.S. Pat. No. 3,536,016 issued to Chesley on Oct. 27, 1970 discloses a knock-down type of shelf cart.

Carts which are foldable or collapsible are also known, as illustrated in the following U.S. Pat. Nos.:

1,304,847; Blais et al; May 27, 1919;
1,408,604; Kawa; Mar. 7, 1922;
2,720,402; DePuy et al; Oct. 11, 1955;
2,865,646; Kronhaus; Dec. 23, 1958;
3,202,438; Panknin et al; Aug. 24, 1965;
4,326,731; Woychio et al; Apr. 27, 1982.

The Blais et al U.S. Pat. No. 1,304,847 discloses a cart or rack having foldable shelves in which the hinged inner end portions of the shelves are relatively vertically stationary, while the outer end portions of the shelves are elevated when the end frames are collapsed.

The Kawa U.S. Pat. No. 1,408,604 discloses a rack for drying photographic prints including a single connector member 8 having hinged parts 9 and 10, the inner hinged ends of which fold upward as the uprights 5 collapse (FIG. 2).

In the DePuy et al U.S. Pat. No. 2,720,402, the shelf members or trays are always rigid as the end frames are pivotally collapsed against the shelves or trays.

Although the Kronhaus U.S. Pat. No. 2,865,646 discloses a foldable tea cart having vertically spaced pairs of shelf members pivotally connected to the end frames and also to each other so that the pivotally connected inner end portions of the shelf members are elevated during folding, nevertheless, no lift bar or guide bar is incorporated in the Kronhaus cart.

In the Panknin et al U.S. Pat. No. 3,202,438, the side wall members of the shelf structure are connected by a pair of pivotal cross braces for movement of the side frame members toward and away from each other. The posts incorporate a pair of vertical slots to permit the vertical travel of the upper pivotal ends of each of the cross braces.

The Woychio et al U.S. Pat. No. 4,326,731 discloses a folding cart having a pair of coplanar hinged shelf members which operates on a principal similar to the Kronhaus cart, and does not incorporate a lift or guide bar for manipulating the hinged shelves.

U.S. Pat. No. 638,100 of Kourtney, issued Nov. 28, 1899, discloses a folding baby carriage.

U.S. Pat. No. 1,198,431 issued to Forsyth on Sept. 19, 1916 discloses a foldable type shelf structure for a shoe rack.

U.S. Stevens U.S. Pat. No. 1,290,398, issued Jan. 7, 1919 discloses a foldable or knock-down type shelf structure used as an oat sprouter.

SUMMARY OF THE INVENTION

It is therefore an object of this invention to provide a foldable or collapsible cart including a plurality of vertically spaced pairs of shelf members hinged or pivoted to a pair of opposed end frames and a lift or guide bar pivotally connected to the opposed inner ends of the pairs of shelf members. The lift bars facilitate the conversion of the cart from an operative position in which the shelf members are substantially horizontal and coplanar to an inoperative folded position, in which the end frames are contracted and the inner end portions of the shelf members are elevated.

The foldable cart made in accordance with this invention may find varied utility in restaurants, institutional food service of all types, health care institutions, warehouses, and other commercial and institutional uses wherever a foldable cart incorporating shelves is needed and can be folded or collapsed to occupy a minimum of space when not in use.

The foldable cart made in accordance with this invention is also lightweight, structurally strong, impact resistant, and incorporates a minimum of parts constructed to balance the distribution of the loads imposed upon the shelves.

The structure of the lift bar assembly in the foldable cart is uniquely designed to limit the downward movement of the shelf members to their substantially horizontal coplanar operative positions, and to adequately support the loaded shelf members in their operative positions.

The foldable cart made in accordance with this invention incorporates a lift bar or guide bar pivotally connected to the inner ends of the paired shelf members. The lift bar includes a vertical slot in which travels a pin member connecting a pair of stabilizer bars which extend angularly downward from the pin member to their pivotal connections with the end frames. In the operative position of the shelf members, the pin member engages a stop comprising the upper end portion of the vertical slot. Moreover, the lift bars extend above the top shelf member and terminate in handle members to facilitate raising the lift bars to convert the cart from its load-supporting operative position to its folded inoperative position.

BRIEF DESCRIPTION OF THE DRAWINGS

FIG. 1 is a top perspective view of the foldable cart made in accordance with this invention, in which the shelf members are solid and the cart is in an operative position;

FIG. 2 is a side elevational view of the cart disclosed in FIG. 1, in an inoperative folded position;

FIG. 5 is an enlarged fragmentary section taken along the line 5—5 of FIG. 3;

FIG. 6 is an enlarged section taken along the line 6—6 of FIG. 4, illustrating the cart in a folded inoperative position;

FIG. 7 is a perspective view similar to FIG. 1, of a modified cart including shelf rail members;

FIG. 8 is an enlarged fragmentary sectional elevation taken along the line 8—8 of FIG. 7, indicating the upper portion of the cart in a folded position;

FIG. 9 is an enlarged fragmentary section taken along the line 9—9 of FIG. 7;

FIG. 10 is an enlarged fragmentary inside perspective view of a modified pivotal connection between the shelf rail members of a cart, such as that illustrated in FIG. 7; and FIG. 11 is a fragmentary inside elevational view, similar to FIG. 8, illustrating the modified pivotal connection of FIG. 10 in a folded inoperative position.

DESCRIPTION OF THE PREFERRED EMBODIMENTS

Figure 4:
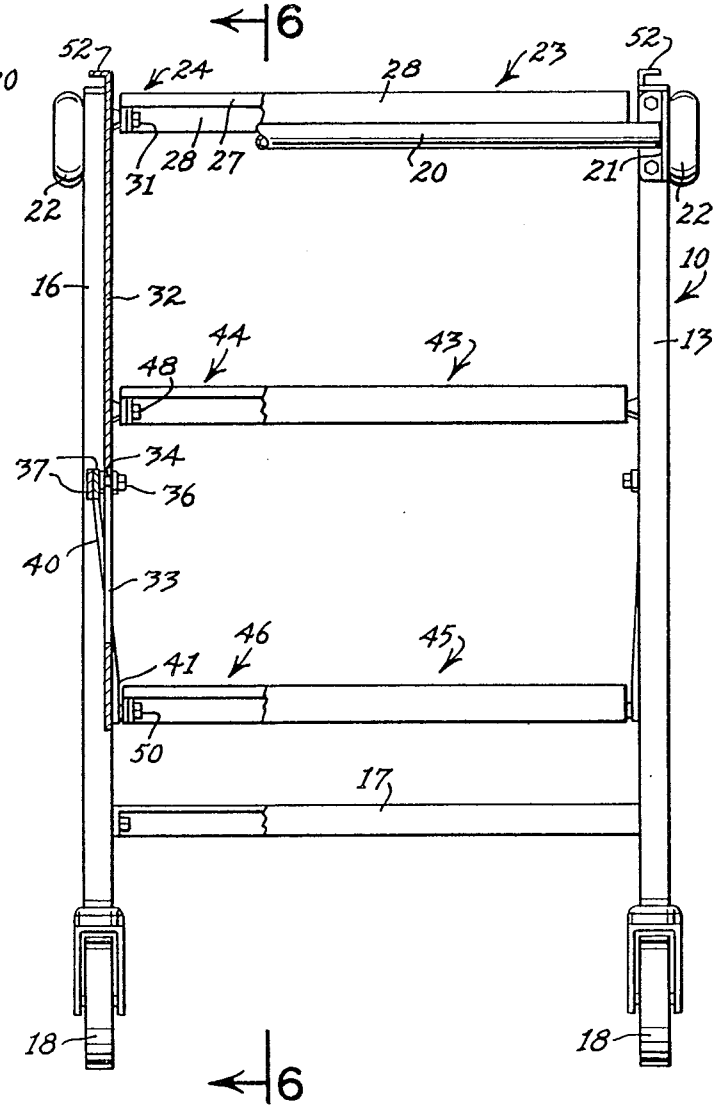
FIG. 4 is a left end elevation of the cart disclosed in FIG. 3, with portions broken away along the line 4—4 of FIG. 3.

Referring now to the drawings in more detail, FIGS. 1–6 disclose a preferred embodiment of a foldable cart 10 made in accordance with this invention. The cart 10 includes a pair of longitudinally spaced end frames 11 and 12, each of which is substantially identical. Each of the end frames 11 and 12 includes a pair of transversely spaced, vertical frame posts 13 and 14, and 15 and 16, respectively. Each pair of end frame posts 13–14 and 15–16 are connected by a lower transverse spacer bar 17, and are swivelly connected at their bottom ends to wheels or casters 18 to provide mobility for the cart 10.

The transverse handle bar 20 is connected at its opposite ends by brackets 21 to the upper end portions of the vertical posts 13 and 14. A similar handle bar 20 is also connected by identical brackets 21 to the upper end portions of the posts 15 and 16. As disclosed in the drawings, the ends of the handle bars 20 projecting laterally beyond or outboard of the brackets 21 may be provided with bumpers, such as the annular resilient bumpers 22, for absorbing the impact of the cart 10 against a wall or other object.

A pair of uppermost or top shelf members 23 and 24 are preferably of equal size, rectangular, and when disposed in a horizontal, coplanar position, as illustrated in FIG. 1, extend the full length of the cart 10. As disclosed in the drawings, each of the shelf members 23 and 24 has a solid top surface 25, depending side flanges 26, an inner end flange 27 and an outer end flange 28. The inner end flanges 27 of both shelf members 23 and 24 are opposed to each other. Moreover the flanges 27 are bent back upon themselves, as best disclosed in FIG. 3, to eliminate any sharp edges exposed to contact by objects or by human hands when the cart 10 is in its folded position, as illustrated in FIGS. 2 and 6.

The outer end portions of each of the top shelves 23 and 24 are pivotally connected by first journal means, such as the pivot pins or pin members pins 30 to the upper end portions of the respective pairs of frame posts 13–14 and 15–16. These pivot pins 30 may extend through the outer end portions of the opposed side flanges 26 and are journaled into the opposed frame posts 13–16. Thus, the top shelf members 23 and 24 are free to pivot in a vertical plane about the transverse axes of the pin members 30 relative to the end frames 11 and 12.

The inner end portions of each of the top shelves 23 and 24 are pivotally connected or journaled by second journal means, such as the inner pivot pins or pin members 31 to the upper end portion of a vertical lift or guide bar 32. The pin members 31 are shown as extending through the respective inner end portions of the side flanges 26.

The lower end portion of the vertical lift bar 32 includes an elongated vertical guide slot 33 formed through the lift bar 32 and terminating in an upper closed slot end portion 34 and a bottom closed slot end portion 35.

Extending transversely through the vertical slot 33 is a guide pin means or member 36 which is free to travel vertically in the slot 33 and is also pivotally connected to the opposing, preferably overlapping, inner or guide end portions 37 of a pair of elongated stabilizer arms 39 and 40, having outer or frame end portions 41. The outer end portions 41 of the stabilizer arms 39 and 40 may be pivotally connected or journaled to the lower portions of the corresponding posts 13–16 by third journal means, such as the outer pivot pin members 42.

Figure 3:
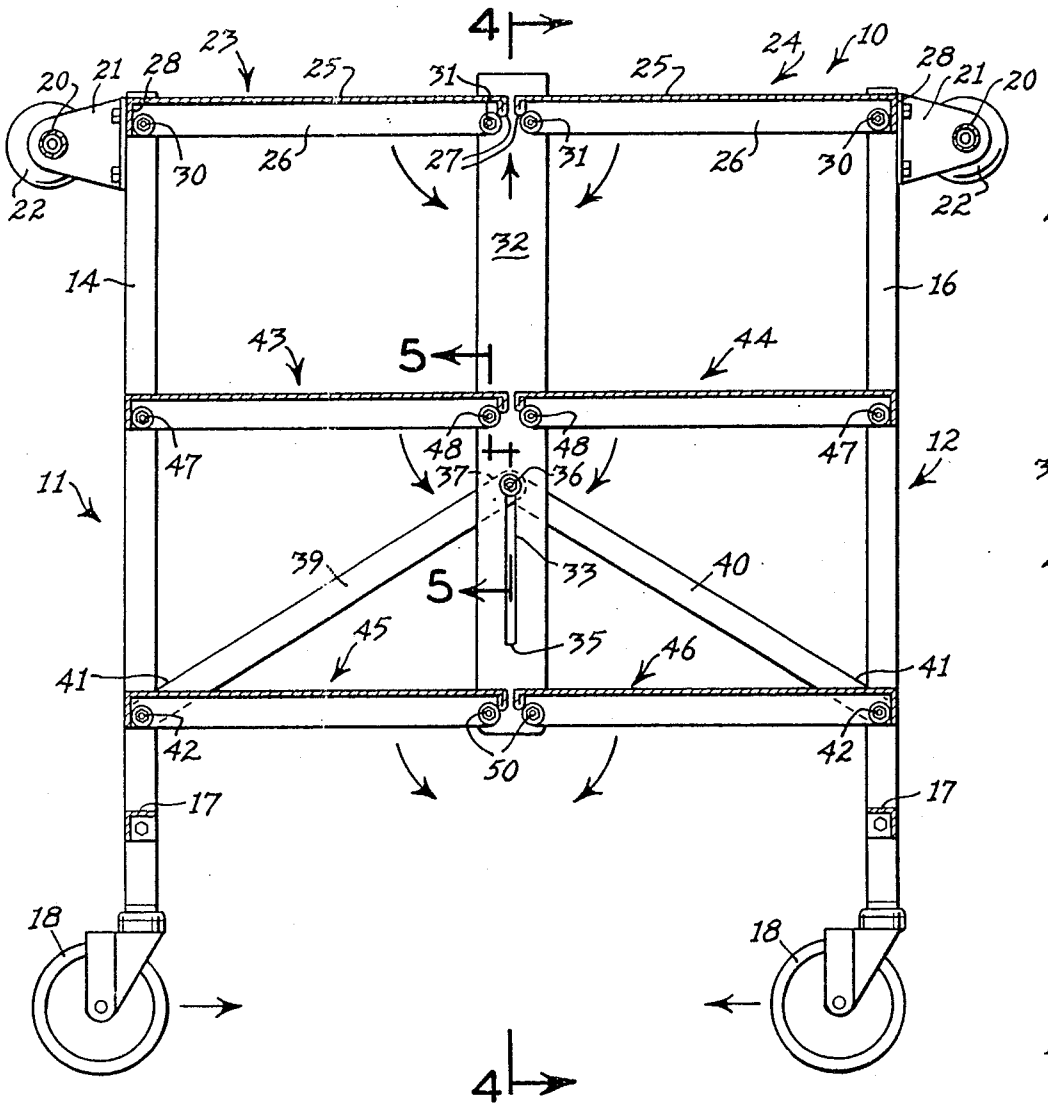
FIG. 3 is an enlarged section taken along the line 3—3 of FIG. 1.

As illustrated in FIGS. 1 and 3, the length of each slot 33 and the lengths of the stabilizer arms 39 and 40 are such that the guide pin member 36 abuts against the upper slot end portion 34 when the top shelves 23 and 24 are coplanar, and the end frames 11 and 12 are fully longitudinally expanded. Thus, the top shelves 23 and 24 can swing downward no farther than their horizontal coplanar position because the guide pin member 36 abuts against the upper or stop end portion 34 of the slot 33.

As illustrated in FIG. 3, the guide pin member 36 is located substantially above the outer pivot pin members 42, so that each of the stabilizer arms 39 and 40 is longer than a corresponding top shelf member 23 or 24 to provide a truss-like support for the shelves 23 and 24 in their coplanar operative, load-bearing position.

The depth of the slot 33 is great enough to permit the inner end portions of the shelves 23 and 24 to swing upwardly to a folded inoperative position in which the end frames 11 and 12 are drawn toward each other to a collapsed position, as illustrated in FIGS. 2 and 6. The bottom slot end portion 34 is low enough on the lift bar 32 to permit the end frames 11 and 12 to be drawn close enough to each other to occupy a minimum of space in the collapsed position. However the bottom slot end portion 34 is high enough on the lift bar 32 to limit the foldability of the cart 10 and the spacing between the opposed end frames 11 and 12 in their collapsed positions to permit the cart 10 to remain free-standing and not readily topple over. The cart 10, made in accordance with this invention, can occupy, in its folded, collapsed position as illustrated in FIGS. 2 and 6, about one-third of the space occupied by the cart 10 in its fully expanded operative position, as illustrated in FIGS. 1 and 3.

In a preferred form of the invention, the cart 10 is provided with other pairs of shelf members, such as 43 and 44, and 45 and 46, spaced below the top shelf members 23 and 24. Each of the shelf members 43, 44, 45, and 46 is identical in construction to the corresponding solid shelf members 23 and 24, previously described. The outer end portions of the intermediate shelf members 43 and 44 are pivotally secured by outer pivot pin members 47 to the frame posts 13–16, while the inner end portions of the shelf members 43 and 44 are pivotally journaled to the lift bar 32 by the inner pivot pin members 48.

As disclosed in FIG. 3, the inner pivot pin members 48 are journaled to the lift bar 32 above the guide pin member 36 and the slot 33.

As disclosed in the drawings, the bottom shelf members 45 and 46 are located below the slot 33 in the lift bar 32. The outer end portions of the bottom shelf members 45 and 46 may be pivotally connected to the frame posts 13–16 by the same outer pivot pin members 42 which connect the outer end portions of the stabilizer arms 39 and 40 to the same corresponding frame posts. The inner end portions of the bottom shelf members 45 and 46 are pivotally connected to the bottom portion of the lift bar 32 below the guide slot 33 by the inner pivot pin members 50.

As illustrated, particularly in FIG. 3, all of the outer pivot pin members 30, 47, and 42 connected to each of the corresponding frame posts 13 and 16 are in vertical alignment. Moreover, all of the inner pivot pin members 31, 48, and 50 pivotally connecting their corresponding inner end portions of the shelves 23, 43, and 45, and the shelves 24, 44, and 46, respectively, are in vertical alignment. The guide pivot pin member 36 and its corresponding slot 33 are located on a vertical axis, preferably centrally of the lift bar 32 and midway between the opposed pairs of inner pivot pin members 31, 48 and 50.

The upper end of each of the lift bars 32 is preferably bent outboard to form a lift tab or handle 52 to facilitate gripping the lift bar 32 in order to raise the lift bar 32 to fold the cart 10 into its collapsed, folded position, as illustrated in FIGS. 2 and 6.

Although, only a single lift bar 32 with its corresponding stabilizing bars 39 and 40 and the guide pin member 36 have been described, in a preferred form of the invention, duplicate guide bars 32 and stabilizing arms 39 and 40 are provided on each side of the cart 10, as illustrated in the drawings.

FIGS. 7–9 disclose a modified form of cart 60 incorporating end frames 61 and 62 supporting the vertically spaced pairs of shelf members 63–64, 65–66, and 67–68 of different construction from their counterparts in cart 10. The end frame 61 includes a unitary tubular member bent into an inverted U-shape to form a pair of end frame posts 69 and 70 and a transverse handle bar 71. The bottom ends of the posts 69 and 70 are swivelly connected to corresponding casters 18, in the same manner as the posts 13 and 14. In like manner, the end frame 62 is formed of an inverted U-shaped unitary tubular member forming the vertical parallel frame posts 73 and 74 joined by the upper transverse handle bar 75.

Each of the top shelf members 63 and 64 include a pair of opposed shelf rails 77. As disclosed in the drawings, each shelf rail 77 is in the form of an elongated angle bar or rail having a vertical flange 78 and a horizontal flange 79. The outer end portions of each of the vertical flanges 78 is pivotally connected by outer pivot pin members 80 to the corresponding vertical frame posts 69, 70, 73, and 74. The inner overlapping end portions of the vertical flanges 78 are pivotally connected together and to the upper end portion of the respective lift bars 32 by single inner pivot pin members 81. The inner end portions of the horizontal flanges 79 may be relieved to permit a greater angle of swing or pivotal motion by the shelf rail 77, as best disclosed in FIGS. 7 and 8.

The horizontal flanges 79 of the shelf rail 77 are designed to be colinear and coplanar in their horizontal operative position, as disclosed in FIG. 7, to support the outward projecting side rims or flanges 82 of a receptacle 83 shown in phantom in FIG. 7. Since the end frame 61 and 62 are U-shaped and open, the receptacle 83 may be introduced through either end of the cart 60, so that the side receptace flanges 82 may be supported and slide upon the horizontal supporting flanges 79 of the shelf rails 77.

Solid shelves, not shown, may also be designed to be inserted through either end of the cart 60 and rest upon, or slide upon the horizontal flanges 79 of the shelf rails 77.

The lift bars 32 in the cart 60 may be identical to the lift bars 32 in the cart 10, except that the lift bars 32 in the cart 60 are connected by the single pivot pin members 81 to the top shelf members, instead of by the dual inner pin members 31 of the cart 10.

The intermediate shelf members 65 and 66 are identical in construction to the top shelf members 63 and 64, made of the same pairs of opposed hinged shelf rails 77. The outer ends of the intermediate shelf rail members 65 and 66 are pivotally connected to their corresponding frame posts 69, 70, 73, and 74 by the outer end pin members 85, while their overlapping inner end portions are connected by single pivot pins 86 to the corresponding lift bars 32. The location of the shelf rail members 65 and 66 in the cart 60 may be the same as the corresponding location of the shelf members 43 and 44 in the cart 10.

Likewise, the bottom shelf members 67 and 68 are identical in construction to the top shelf members 63 and 64 incorporating the same angle-shaped shelf rails 77, and occupying substantially the same relative position in the cart 60 as the bottom shelf members 45 and 46 occupy in the cart 10. The outer end portions of the shelf members 67 and 68 are pivotally connected to the outer end portions of the stabilizing arms 39 and 40 and to their corresponding frame posts 69 and 70, and 73 and 74, by the outer pivot pin connectors or members 87, while the inner end portions of the corresponding shelf members 67 and 68 are connected to the bottom portion of the lift bars 32 by the single inner pivot pin members 88.

The cart 60 functions in the same manner as the cart 10 in its folded and expanded positions. As disclosed in FIG. 7, the cart 60 is disclosed in its fully expanded operative position in which all of the shelf members 63–68 are disposed in their corresponding horizontal coplanar positions for supporting one or more receptacles 83 or other loads for transportation to any desired destination. In the operative position of the cart 60, the guide pin members 36 occupy positions within their corresponding vertical slots 33 abutting the upper end portions 34 of the slots to prevent the shelf members 63–66 from swinging downward beyond their horizontal coplanar positions.

By gripping the lift tabs 52 and exerting upward force upon the lift bars 32, the cart 60 is collapsed to its folded position, as illustrated in FIG. 8, in the same manner as the cart 10. During the folding operation of the cart 60, the lift bars 32 and their corresponding slots 33 move upwardly relative to the guide pivot pin members 36, which travel relatively downward along the corresponding slots 33. As illustrated in FIG. 8, the handle bars 71 and 75 are joined by end portions 90 to their corresponding frame posts 69, 70, 73, and 74 to lie in a plane at an angle to the corresponding vertical planes of the end frames 61 and 62. This divergence of the handle members 71 and 75 and their connecting portions 90 provides more room for the swinging upper shelf members 63 and 64 to permit greater contraction of the end frames 61 and 62 in the folded, inoperative position of the cart 60.

FIGS. 10 and 11 disclose the top shelf members 63 and 64 of the cart 60 having a modified shelf rail construction in which the vertical flange 78[1] of the rail 77 in the shelf member 64 has an integral extended locking tongue 92 long enough to project over the bottom flange 79 of the rail 77 of the shelf rail member 63. Thus, when the shelf members 63 and 64 swing to their operative position of FIG. 10, the tongue 92 abuts against the horizontal flange 79 to provide an extra locking feature to hold the shelf member 63 and 64 in their operative horizontal coplanar positions, in addition to the engagement of the guide pivot pin member 36 with the upper slot end portion 34 in the lift bar 32

Although the inner end portions of the shelf members of the respective carts 10 and 60 may be connected to their corresponding lift bars 32 by single pivot pin members, such as the pivot pin members 81, 86, and 88, nevertheless, the carts 10 or 60 may be folded to a more contracted inoperative position to occupy less space if the inner end portions of the shelf members are connected to their respective lift bars 32 by double inner pivot pin members, such as 31, 48, and 50, as disclosed in FIG. 6.

It will therefore be seen that a versatile mobile shelf cart, 10 or 60, has been developed, which is lightweight and strong enough to adequately support a substantial load and substantial numbers of small articles when the shelf members are folded to their horizontal operative positions. Furthermore, the structure of the carts 10 and 60 permit the shelf members to very readily swing upward to an inoperative folded position in which the end frames are collapsed closely adjacent each other so the cart 10 or 60 may occupy a minimum of space, in the order of one-third of the spaced occupied by the fully expanded end frames and shelves of the cart 10 or 60.

The lift bar construction permits a very rapid folding operation in which the lift handles 52 are grasped and pulled upwardly to convert the carts 10 and 60 from a fully expanded operative position to a fully folded inoperative position.

The lift bar construction 32 also provides the sole but adequate stop support for limiting the downward folding movement of the pairs of vertically spaced shelf members disclosed in FIGS. 1–9, by virtue of the pivot pin members 36 connected to the stabilizer arms 39 and 40 abutting against the upper end portions 34 of the vertical slots 33 in the corresponding lift bars 32. Furthermore, only a single lift bar 32 on each side of the corresponding cart 10 and 60 is needed for the pivotal connection of all of the inner end portions of the pairs of shelf members, so that all the shelf members move in unison with the movement of the lift bars 32.

The location of the vertical slot 33 and the guide pivot pin member 36 is such as to provide a stable truss support by virtue of the angularly disposed upward and inward converging stabilizer arms 39 and 40 to adequately transfer the downward thrust of the loaded shelf members through the stabilizer arms 39 and 40 uniformly to the opposite end frames of the carts.

What is claimed is:

1. A foldable cart comprising:

(a) a pair of longitudinal spaced upright end frames, each end frame having a bottom end portion terminating in a ground-engaging wheel member, (b) a pair of shelf members having outer end portions and opposed inner end portions, (c) first journal means connecting said outer end portions of each of said shelf members to a corresponding opposite end frame for pivotal movement of said respective shelf members in a vertical plane relative to said end frames, (d) a vertically disposed lift bar, (e) second journal means pivotally connecting both said inner end portions to said lift bar for pivotal movement of said shelf members in a vertical plane relative to said lift bar, (f) a pair of stabilizing arms having opposed guide end portions and outer frame end portions, (g) guide pin means pivotally connecting said guide end portions, (h) third journal means connecting each of said frame end portions to a corresponding opposite end frame for pivotal movement of said respective stabilizing arms in a vertical plane, (i) elongated vertical guide means on said lift bar cooperating with said guide pin means to permit vertical movement of said lift bar relative to said guide pin means between an elevated inoperative position in which said end frames are contracted toward each other to fold said shelf members and a lower operative load-bearing position in which said end frames are expanded apart from each other and said shelf members are substantially horizontally coplanar, (j) stop means on said lift bar for limiting the downward vertical movement of said lift bar to said operative position.

2. The invention according to claim 1 in which said guide means comprises a vertical guide slot receiving said guide pin means for vertical travel relative to said guide slot.

3. The invention according to claim 2 in which said stop means comprises the upper end portion of said guide slot.

4. The invention according to claim 3 further comprising a plurality of vertically spaced pairs of said shelf members, a corresponding number of vertically spaced first journal means connecting the outer end portions of said shelf members to said opposite end frames and a plurality of vertically spaced second journal means connecting said inner end portions of said shelf members to said lift bar.

5. The invention according to claim 4 in which one of said second journal means connects both said inner end portions of one pair of shelf members to said lift bar at a pivotal position below said guide slot and another of said second journal means connects both said inner end portions of another pair of shelf members to said lift bar above said guide slot.

6. The invention according to claim 5 in which the first journal means for said pair of shelf members pivotally connected to said lift bar below said vertical slot are coaxial with said corresponding third journal means.

7. The invention according to claim 3 in which said vertical guide slot comprises a bottom end portion below said upper end portion adapted to engage said guide pin means and to limit the upward vertical movement of said lift bar to said inoperative position.

8. The invention according to claim 1 in which said guide means comprises limit means cooperating with said guide pin means to limit the upward vertical movement of said lift bar to said inoperative position.

9. The invention according to claim 1 in which said shelf members comprise solid planar shelf surfaces.

10. The invention according to claim 9 in which at least one of said end frames comprises a transverse handle member spaced below said planar shelf surfaces.

11. The invention according to claim 1 in which said shelf members comprises longitudinally extending parallel shelf rails for slidably receiving and supporting a receptacle on said rails.

12. The invention according to claim 11 in which said inner end portions of said pair of shelf members comprises overlapping rail portions and a stop flange member on one of said inner end portions for limiting the downward movement of the overlapping rail portion of said other rail member when said pair of shelf members are in said operative position.

13. The invention according to claim 1 in which each of said end frames comprises a pair of vertically extending posts transversely spaced to form openings between said posts to receive articles through said openings for support on said shelf members.

14. The invention according to claim 1 in which the upper end portion of said lift bar projects above said pair of shelf members in said operative position and terminates in a handle member.

15. The invention according to claim 1 in which at least one of said end frames comprises a transverse handle bar.

16. The invention according to claim 1 in which said second journal means comprises a pair of pivot pins journaled on said lift bar, one of said pair of pivot pins being journaled to one of said inner end portions, while the other of said pair of pivot pins is journaled to said other end portion.

17. The invention according to claim 1 in which said second journal means comprises a single pivot pin pivotally connecting said lift bar to both said inner end portions of said shelf members.

* * * * *